US011117705B1

(12) United States Patent
Law

(10) Patent No.: US 11,117,705 B1
(45) Date of Patent: Sep. 14, 2021

(54) FLUID CARTON ASSEMBLY

(71) Applicant: Donald Law, Bronx, NY (US)

(72) Inventor: Donald Law, Bronx, NY (US)

( * ) Notice: Subject to any disclaimer, the term of this patent is extended or adjusted under 35 U.S.C. 154(b) by 0 days.

(21) Appl. No.: 16/890,086

(22) Filed: Jun. 2, 2020

(51) Int. Cl.
*B65D 5/72* (2006.01)
*B65D 5/06* (2006.01)
*B65D 5/44* (2006.01)

(52) U.S. Cl.
CPC ..... *B65D 5/723* (2013.01); *B65D 5/068* (2013.01); *B65D 5/443* (2013.01)

(58) Field of Classification Search
CPC ..... B65D 5/723; B65D 5/068; B65D 5/443; B65D 5/069; B65D 33/2591; B65D 5/063; B65D 5/067
USPC ..... 229/129.1, 125.12, 125.42, 249, 125.39, 229/125.04; D9/435; 292/343
See application file for complete search history.

(56) References Cited

U.S. PATENT DOCUMENTS 2,336,503 A * 12/1943 Ringler ..... B65D 5/069 383/69
3,217,967 A 11/1965 Jackson
3,458,110 A * 7/1969 Goldman ..... B65D 5/069 229/125.12
3,680,771 A 8/1972 Blunsdon
3,693,864 A 9/1972 Wilkins
4,619,398 A * 10/1986 Laramie ..... B65D 5/069 229/125.12
4,756,426 A * 7/1988 Wyberg ..... B65D 5/068 229/125.42
4,872,562 A * 10/1989 Wyberg ..... B65D 5/068 206/523
4,979,668 A 12/1990 Allen
5,462,222 A 10/1995 Boeck, II
5,518,173 A * 5/1996 Wald ..... B65D 5/069 229/125.39
5,809,621 A 9/1998 McCree
6,581,253 B2 6/2003 ErkenBrack
7,029,178 B2 4/2006 Gzybowski
2007/0280564 A1 12/2007 Lyon

* cited by examiner

*Primary Examiner* — Christopher R Demeree

(57) ABSTRACT

A fluid carton assembly for dispensing and storing a liquid beverage includes a beverage carton for storing a liquid beverage. The beverage carton has a pair of flaps each being positionable in an open position to pour the liquid beverage. The flaps are positionable in a closed position to contain the liquid beverage. A slide is slidably coupled to each of the flaps. The slide is slidable into a closing position thereby retaining the flaps in the closed position. The slide is slidable into an opening position thereby facilitating the flaps to be positioned in the open position.

6 Claims, 5 Drawing Sheets

FLUID CARTON ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to carton devices and more particularly pertains to a new carton device for dispensing and storing a liquid beverage.

BRIEF SUMMARY OF THE INVENTION

An embodiment of the disclosure meets the needs presented above by generally comprising a beverage carton for storing a liquid beverage. The beverage carton has a pair of flaps each being positionable in an open position to pour the liquid beverage. The flaps are positionable in a closed position to contain the liquid beverage. A slide is slidably coupled to each of the flaps. The slide is slidable into a closing position thereby retaining the flaps in the closed position. The slide is slidable into an opening position thereby facilitating the flaps to be positioned in the open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
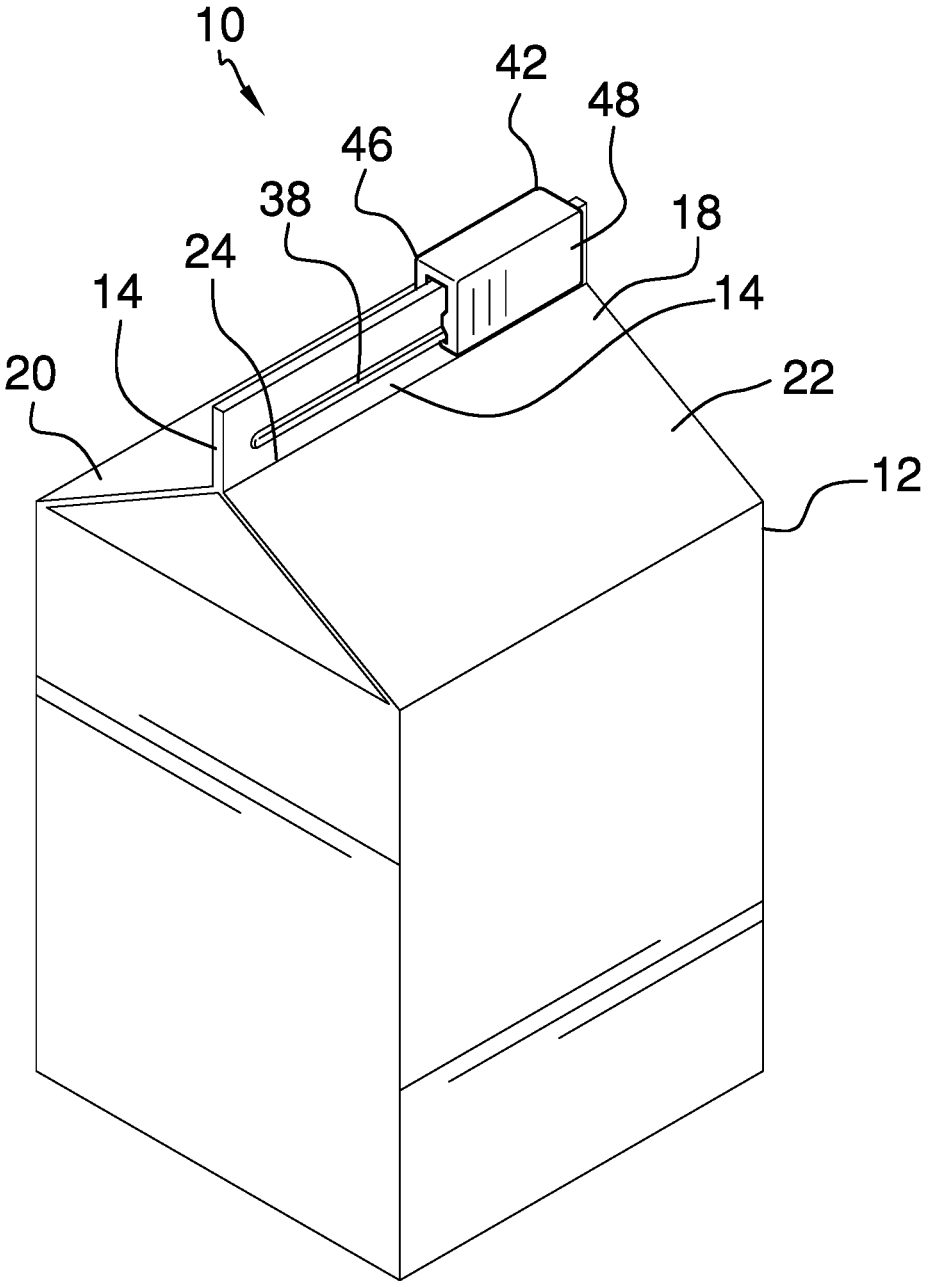
FIG. 1 is a top perspective view of a fluid carton assembly according to an embodiment of the disclosure.
Figure 2:
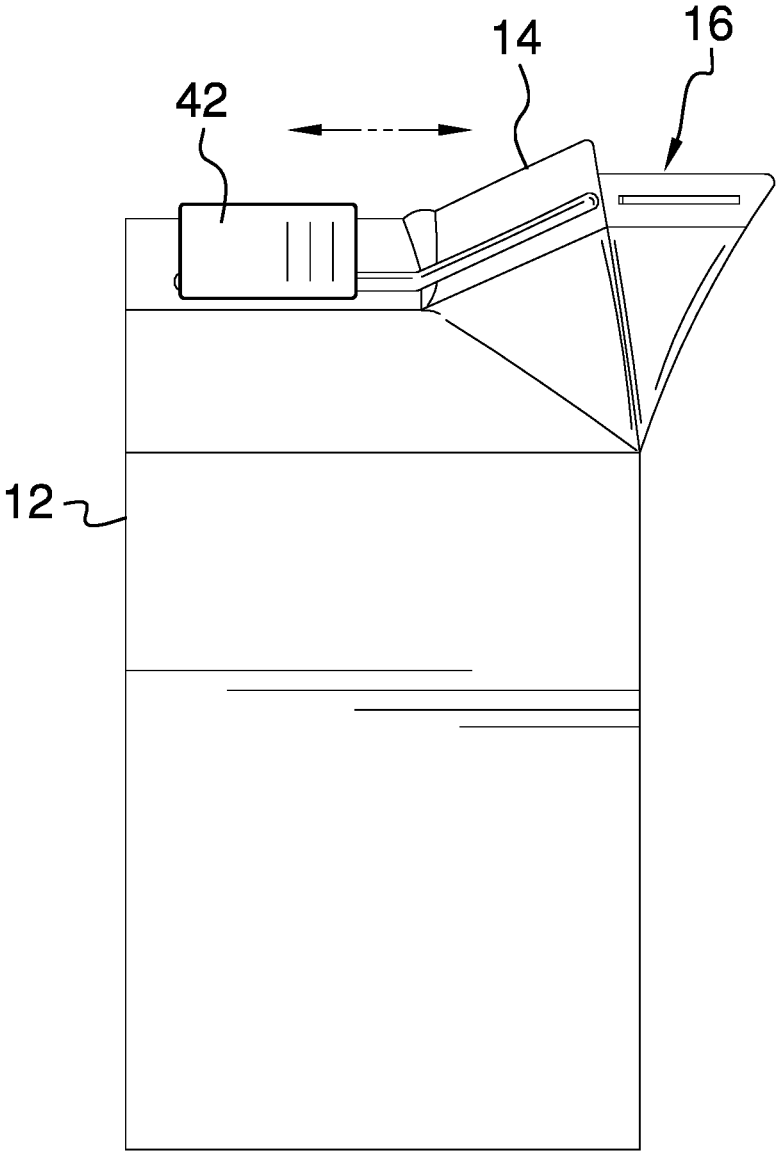
FIG. 2 is a right side view of an embodiment of the disclosure showing a slide being slid into an opening position.
Figure 3:
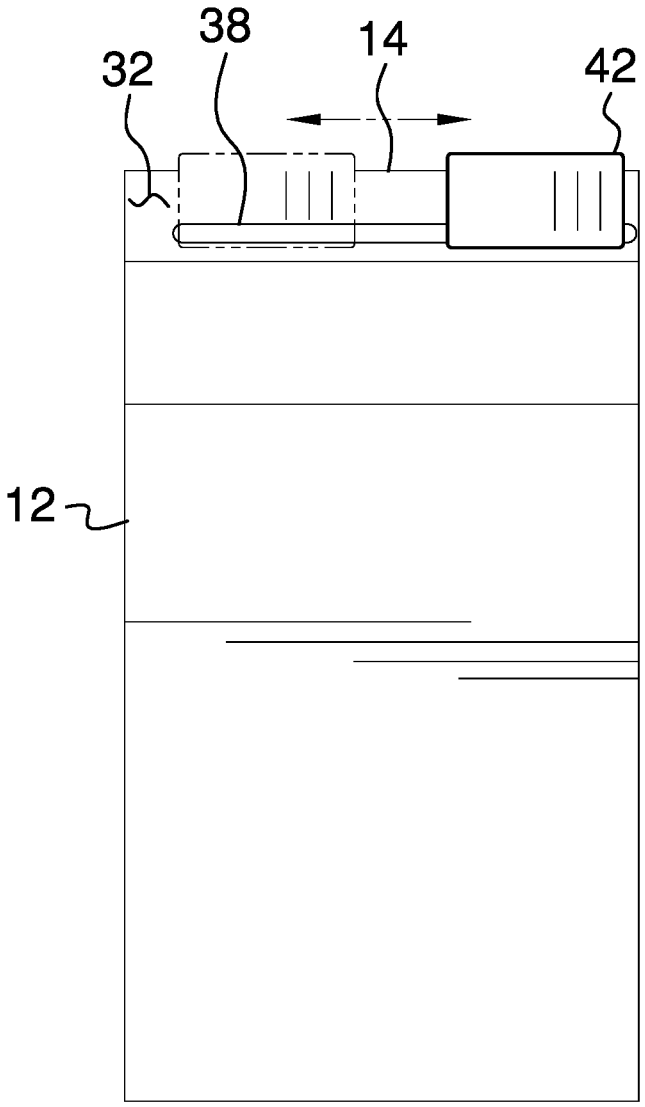
FIG. 3 is a right side view of an embodiment of the disclosure showing a slide being slid into a closing position.
Figure 4:
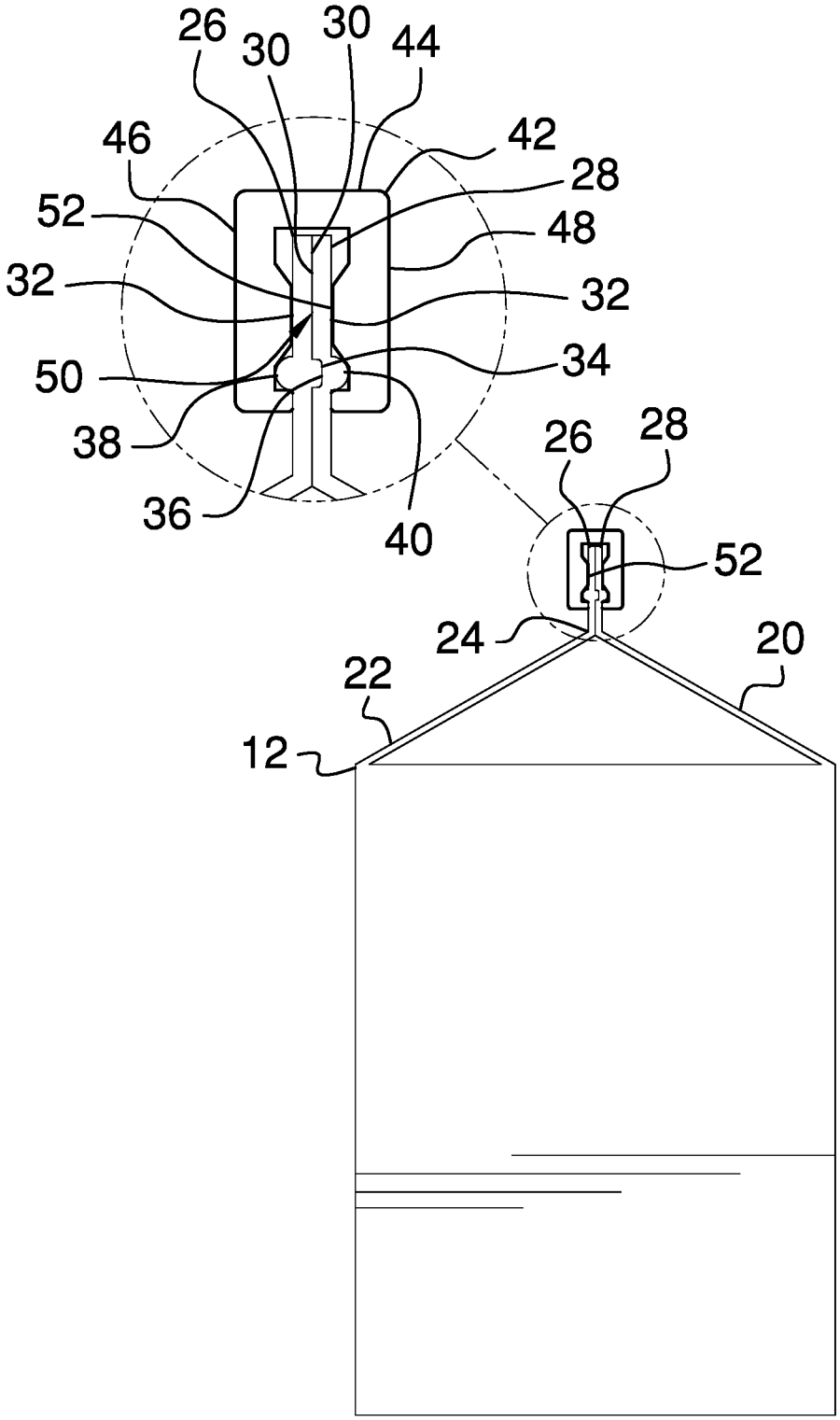
FIG. 4 is a front view of an embodiment of the disclosure.
Figure 5:
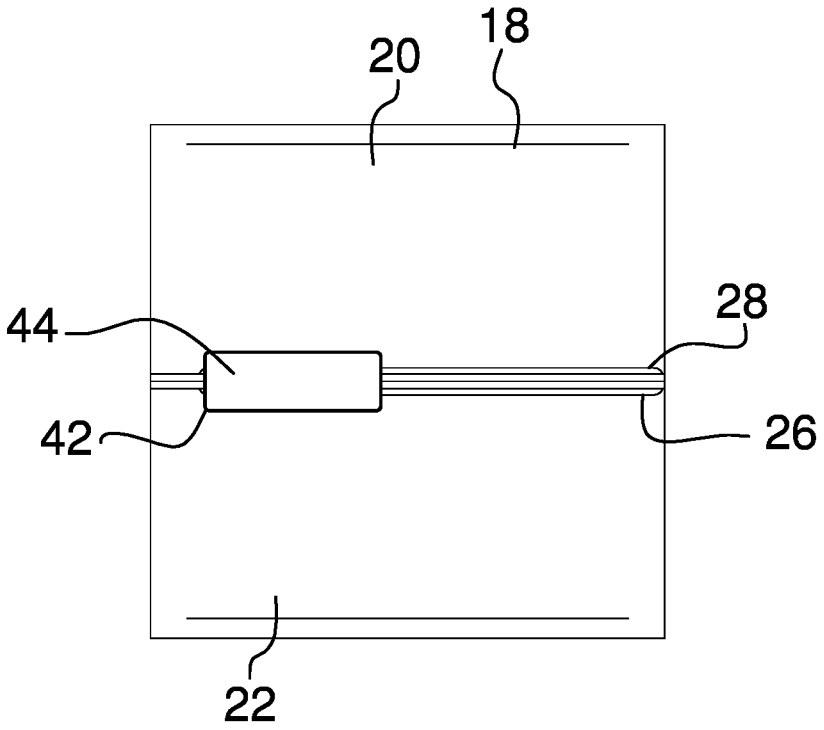
FIG. 5 is a top view of an embodiment of the disclosure.

With reference now to the drawings, and in particular to FIGS. 1 through 5 thereof, a new carton device embodying the principles and concepts of an embodiment of the disclosure and generally designated by the reference numeral 10 will be described.

As best illustrated in FIGS. 1 through 5, the fluid carton assembly 10 generally comprises a beverage carton 12 for storing a liquid beverage. The beverage carton 12 has a pair of flaps 14 each being positionable in an open position to define a spout 16 for pouring the liquid beverage. The flaps 14 are positionable in a closed position to contain the liquid beverage. The beverage carton 12 has a top wall 18 and the top wall 18 has a first side 20 and a second side 22. The first side 20 and the second side 22 slope upwardly to define a peak 24 on the carton 12. The beverage carton 12 is manufactured with the liquid beverage stored therein and the beverage carton 12 may be sold in a retail environment or the like.

Each of the flaps 14 extends along the peak 24. The pair of flaps 14 includes a first flap 26 and a second flap 28. Each of the first flap 26 and the second flap 28 has a primary surface 30 and a secondary surface 32. The primary surface 30 of the first flap 26 abuts the primary surface 30 of the second flap 28 when the flaps 14 are in the closed position. The primary surface 30 of the first flap 26 has an engagement 34 extending outwardly therefrom. The engagement 34 extends along an entire length of the first flap 26.

The primary surface 30 of the second flap 28 has a groove 36 extending toward the secondary surface 32 of the second flap 28. The groove 36 is coextensive with the engagement 34. The engagement 34 engages the groove 36 when the first flap 26 and the second flap 28 are positioned in the closed position. The engagement 34 forms a fluid impermeable seal with the groove 36 to retain the liquid beverage in the carton 12.

The secondary surface 32 of the first flap 26 has a first prominence 38 thereon. The first prominence 38 extends along a substantial length of the first flap 26. The secondary surface 32 of the second flap 28 has a second prominence 40 therein. The second prominence 40 extends along a substantial length of the second flap 28.

A slide 42 is slidably coupled to each of the flaps 14. The slide 42 is slidable into a closing position thereby retaining the flaps 14 in the closed position. The slide 42 is slidable into an opening position thereby facilitating the flaps 14 to be positioned in the open position. In this way the beverage carton 12 can be opened and closed multiple times.

The slide 42 has a top wall 44 extending between a first lateral wall 46 and a second lateral wall 48. The first lateral wall 46 is spaced from the second lateral wall 48 to define a flap space 50 extending between the first lateral wall 46 and the second lateral wall 48. Each of the first flap 26 and the second flap 28 is positioned in the flap space 50. Each of the first lateral wall 46 and the second lateral wall 48 has an inwardly facing surface 52. The inwardly facing surface 52 of each of the first lateral wall 46 and the second lateral wall 48 engages a respective one of the first prominence 38 and the second prominence 40.

In use, the slide 42 is slid into the opening position thereby facilitating the first flap 26 and the second flap 28 to be positioned on the open position. In this way the liquid beverage can be poured from the beverage carton 12. The first flap 26 and second flap 28 are positioned in the closed position and the slide 42 is slid into the closing position. In this way the beverage carton 12 can be closed for storing liquid beverage that remains in the beverage carton 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fluid carton assembly being configured to contain and dispense a fluid beverage, said assembly comprising:

a beverage carton being configured to store a liquid beverage, said beverage carton having a pair of flaps each being positionable in an open position to define a spout wherein said spout is configured to pour the liquid beverage, said flaps being positionable in a closed position wherein said flaps are configured to contain the liquid beverage, said beverage carton having a top wall and an outer wall, said top wall having a first side and a second side, said first side and said second side sloping upwardly from said outer wall to define a peak on said carton, each of said flaps extending along said peak, said pair of flaps including a first flap and a second flap, each of said first flap and said second flap having a primary surface and a secondary surface, said primary surface of said first flap abutting said primary surface of said second flap when said flaps are in said closed position, said primary surface of said first flap has a engagement extending outwardly therefrom, said engagement extending along an entire length of said first flap, said primary surface of said second flap has a groove extending toward said secondary surface of said second flap, said groove being coextensive with said engagement, said engagement engaging said groove when said first flap and said second flap are positioned in said closed position, said engagement forming a fluid impermeable seal with said groove wherein said first flap and said second flap are configured to retain the liquid beverage in said carton; and a slide being slidably coupled to each of said flaps, said slide being slidable into a closing position thereby retaining said flaps in said closed position, said slide being slidable into an opening position thereby facilitating said flaps to be positioned in said open position.

2. The assembly according to claim 1, wherein said secondary surface of said first flap has a first prominence thereon, said first prominence extending along a substantial length of said first flap.

3. The assembly according to claim 2, wherein said secondary surface of said second flap has a second prominence therein, said second prominence extending along a substantial length of said second flap.

4. The assembly according to claim 3, wherein said slide has a top wall extending between a first lateral wall and a second lateral wall, said first lateral wall being spaced from said second lateral wall to define a flap space extending between said first lateral wall and said second lateral wall, each of said first flap and said second flap being positioned in said flap space.

5. The assembly according to claim 4, wherein each of said first lateral wall and said second lateral wall has an inwardly facing surface, said inwardly facing surface of each of said first lateral wall and said second lateral wall engaging a respective one of said first prominence and said second prominence.

6. A fluid carton assembly being configured to contain and dispense a fluid beverage, said assembly comprising:

a beverage carton being configured to store a liquid beverage, said beverage carton having a pair of flaps each being positionable in an open position to define a spout wherein said spout is configured to pour the liquid beverage, said flaps being positionable in a closed position wherein said flaps are configured to contain the liquid beverage, said beverage carton having a top wall, said top wall having a first side and a second side, said first side and said second side sloping upwardly from said outer wall to define a peak on said carton, each of said flaps extending along said peak, said pair of flaps including a first flap and a second flap, each of said first flap and said second flap having a primary surface and a secondary surface, said primary surface of said first flap abutting said primary surface of said second flap when said flaps are in said closed position, said primary surface of said first flap having an engagement extending outwardly therefrom, said engagement extending along an entire length of said first flap, said primary surface of said second flap having a groove extending toward said secondary surface of said second flap, said groove being coextensive with said engagement, said engagement engaging said groove when said first flap and said second flap are positioned in said closed position, said engagement forming a fluid impermeable seal with said groove wherein said first flap and said second flap are configured to retain the liquid beverage in said carton, said secondary surface of said first flap having a first prominence thereon, said first prominence extending along a substantial length of said first flap, said secondary surface of said second flap having a second prominence therein, said second prominence extending along a substantial length of said second flap; and a slide being slidably coupled to each of said flaps, said slide being slidable into a closing position thereby retaining said flaps in said closed position, said slide being slidable into an opening position thereby facilitating said flaps to be positioned in said open position, said slide having a top wall extending between a first lateral wall and a second lateral wall, said first lateral wall being spaced from said second lateral wall to define a flap space extending between said first lateral wall and said second lateral wall, each of said first flap and said second flap being positioned in said flap space, each of said first lateral wall and said second lateral wall having an inwardly facing surface, said inwardly facing surface of each of said first lateral wall and said second lateral wall engaging a respective one of said first prominence and said second prominence.

* * * * *